US008959670B2

(12) United States Patent
Chiang

(10) Patent No.: US 8,959,670 B2
(45) Date of Patent: Feb. 24, 2015

(54) SWIM GOGGLES

(75) Inventor: Herman Chiang, New Taipei (TW)

(73) Assignee: Global Esprit Inc., New Taipei (TW)

( * ) Notice: Subject to any disclaimer, the term of this patent is extended or adjusted under 35 U.S.C. 154(b) by 647 days.

(21) Appl. No.: 13/081,349

(22) Filed: Apr. 6, 2011

(65) Prior Publication Data

US 2012/0222202 A1 Sep. 6, 2012

(30) Foreign Application Priority Data

Mar. 3, 2011 (TW) ..... 100203720 U

(51) Int. Cl.
*A61F 9/02* (2006.01)
*A63B 33/00* (2006.01)

(52) U.S. Cl.
CPC ..... *A63B 33/002* (2013.01); *A63B 2033/004* (2013.01); *Y10S 24/48* (2013.01)
USPC ..... 2/442; 2/452; 2/440; 24/170; 24/DIG. 48

(58) Field of Classification Search
USPC ..... 2/426, 440, 442, 452, 448; 24/170, 24/593.1, 593.11, DIG. 48
See application file for complete search history.

(56) References Cited

U.S. PATENT DOCUMENTS

| | | | | |
|---|---|---|---|---|
| 4,240,718 | A * | 12/1980 | Wichers | 351/62 |
| 6,081,973 | A * | 7/2000 | Liu | 24/178 |
| 6,832,394 | B1 * | 12/2004 | Chiang | 2/428 |
| 7,134,149 | B2 * | 11/2006 | Sato | 2/431 |
| 7,146,653 | B2 * | 12/2006 | Chou | 2/426 |
| 7,185,373 | B2 * | 3/2007 | Chiang | 2/445 |
| 7,631,400 | B2 * | 12/2009 | Chiang | 24/170 |
| 7,836,561 | B2 * | 11/2010 | Vaccaro et al. | 24/68 E |
| 7,921,523 | B2 * | 4/2011 | Chou | 24/170 |
| 8,225,430 | B2 * | 7/2012 | Chiang | 2/448 |
| 8,312,603 | B2 * | 11/2012 | Chou | 24/170 |
| 2001/0012091 | A1 * | 8/2001 | Fujima | 351/43 |
| 2006/0010585 | A1 * | 1/2006 | Chiang | 2/426 |
| 2006/0015990 | A1 * | 1/2006 | Chiang | 2/426 |
| 2007/0256283 | A1 * | 11/2007 | Chiang | 24/193 |
| 2008/0244875 | A1 * | 10/2008 | Chou | 24/170 |
| 2009/0100645 | A1 * | 4/2009 | Weng | 24/170 |
| 2009/0205114 | A1 * | 8/2009 | Chiang | 2/428 |
| 2009/0229086 | A1 * | 9/2009 | Chiang | 24/170 |
| 2010/0077539 | A1 * | 4/2010 | Chen | 2/452 |
| 2012/0096632 | A1 * | 4/2012 | Chou | 2/452 |
| 2012/0222202 | A1 * | 9/2012 | Chiang | 2/452 |

FOREIGN PATENT DOCUMENTS

GB 2438221 A 11/2007

* cited by examiner

*Primary Examiner* — Shaun R Hurley
*Assistant Examiner* — Andrew W Sutton
(74) *Attorney, Agent, or Firm* — Cheng-Ju Chiang

(57) ABSTRACT

A pair of swim goggles include a lens frame body, a lens unit, and buckle devices, characterized in that each of the buckle devices includes: a resilient element, an engaging arm, and at least a button, wherein the resilient element has a first base plate and a second base plate both bending in a same direction and spaced away from each other, the first and second base plates having end portions at opposite ends thereof, the engaging arm having a connecting end and an engaging end opposite the connecting end, the connecting end connected with the first base plate, the engaging end engaged with a head strap after being assembled, the at least a button having a press portion and a linking portion opposite the press portion, the linking portion connected to one of the end portions of the first and second base plates.

12 Claims, 7 Drawing Sheets

SWIM GOGGLES

BACKGROUND OF THE INVENTION

1. Field of the Invention

The present invention relates to a pair of swim goggles, and more particularly to a pair of swim goggles having buckle devices operated by pressing thereon for adjusting the length of a head strap.

2. Related Art

In wearing swim goggles it is necessary to adjust a head strap to fit a wearer's head. As is well-known, a method of adjusting the head strap is performed by two buckles respectively disposed on left and right sides of the swim goggles. Early design buckles aim to merely connect and position the head strap without considering an easy way to adjust the head strap. Once the head strap is to be adjusted, it has to be drawn back and forth many times. To avoid the inconvenience of adjusting the head strap, recent design buckles further include engaging devices used for limiting the head strap to move in only one direction. Each of the engaging device has an engaging arm capable of engaging tooth-shaped slots of the head strap so as to limit the head strap to be adjusted in only one direction during a period of engagement, that is, the head strap can only be drawn tightly. If the head strap is to be loosened, the engagement of the engaging arm with the head strap has to be released. Therefore, whether the engagement of the engaging arms of the above-mentioned buckles with the head strap relates directly to adjustment of the head strap.

Conventional buckles capable of limiting a head strap to move in one direction are varied according to operating methods, which are generally categorized into two major types: a press-type buckle and a push-type buckle. The operating method of the press type buckle is more compliance with the ergonomic. However, whatever type the buckle is, the engaging arm is required to cooperate with a flexible element in order to return to an engaging state after the engagement is released. Due to swim goggles are used in water, they cannot be made of metal material. Furthermore, the flexible element has to be tested repeatedly to meet flexibility requirements. Although the conventional flexible element is of sufficient flexibility, the structure of the conventional flexible element is rather complicated and is large in volume, which does not conform to a tendency towards light and thin design.

SUMMARY OF THE INVENTION

Accordingly, an object of the present invention is to provide novel swim goggles which are simple in structure and easy to be assembled, and length of a head strap thereof is able to be adjusted effectively by improved buckled devices thereof.

To achieve the above-mentioned objects, a pair of swim goggles includes a lens frame body, a lens unit received in the lens frame body, buckle devices mounted on left and right sides of the lens frame unit, wherein each of the devices includes a first casing and a second casing, and a resilient element, an engaging arm and at least a button all disposed between the first and second casings, wherein the resilient element includes a first base plate and a second base plate both bending in a same direction and spaced away from each other, the first and second base plates having end portions at opposite ends thereof, the engaging arm having a connecting end and an engaging end opposite the connecting end, the connecting end connected with the first base plate, the engaging end engaged with one of the retaining slots of the head strap after being assembled; the at least a button having a press portion and a linking portion opposite the press portion, the linking portion connected to one of the end portions of the first and second base plates.

In accordance with the above-mentioned structure, after assembly, the press portion is exposed to the first and second casings, and one of the end portions of the first and second base plates is against an inner side of the first casing/the second casing; when the button is being pressed, the first and second base plates simultaneously twist and produce a stored energy, and the engaging arm is drawn in a direction as a direction of twisting; thus the engaging end of the engaging arm disengages from the head strap. When stop pressing the button, the stored energy produced by the first and second base plates is released, and therefore the engaging arm returns to its previous position.

In accordance with the above features, the second base plate bends at an angle larger than that of the first base plate.

Further in accordance with the above features, a fitting element is disposed between the first and second base plates and the first and second casings, wherein the fitting element has a fitting face and a connecting face, the connecting face connects the other end portion of the first and second base plates, and the fitting face is completely fitted to the inner side of the first casing/the second casing.

Still further, a plurality of position holes are formed on outer sides of the lens unit, the first casing has a position arm, and the position arm includes a curved portion having a plurality of position sticks for being mounted to respective position holes.

DESCRIPTION OF THE PREFERRED EMBODIMENTS

Figure 1:
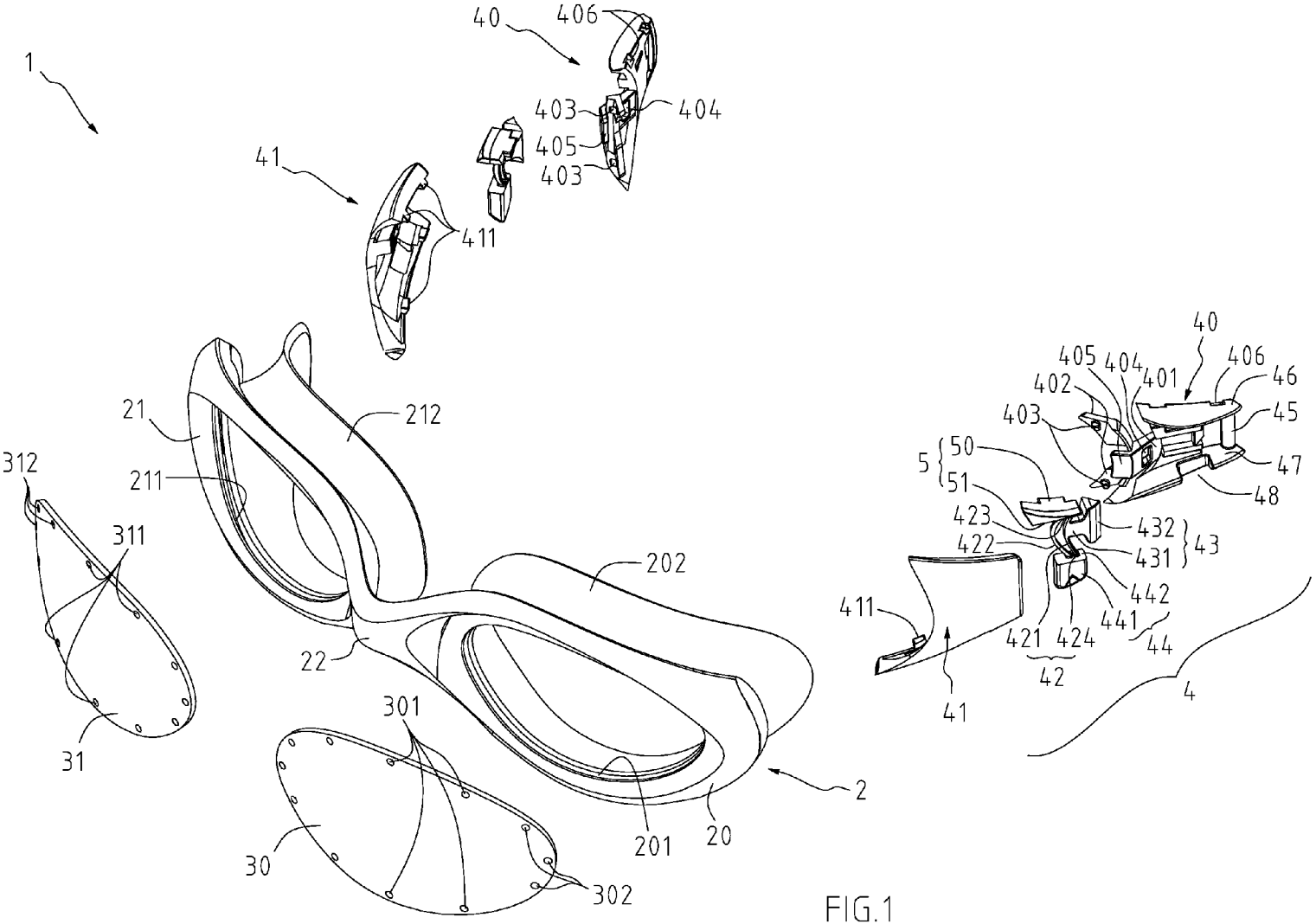
FIGS. 1 and 2 are different perspective exploded views of a pair of swim goggles of the present invention.
Figure 2:
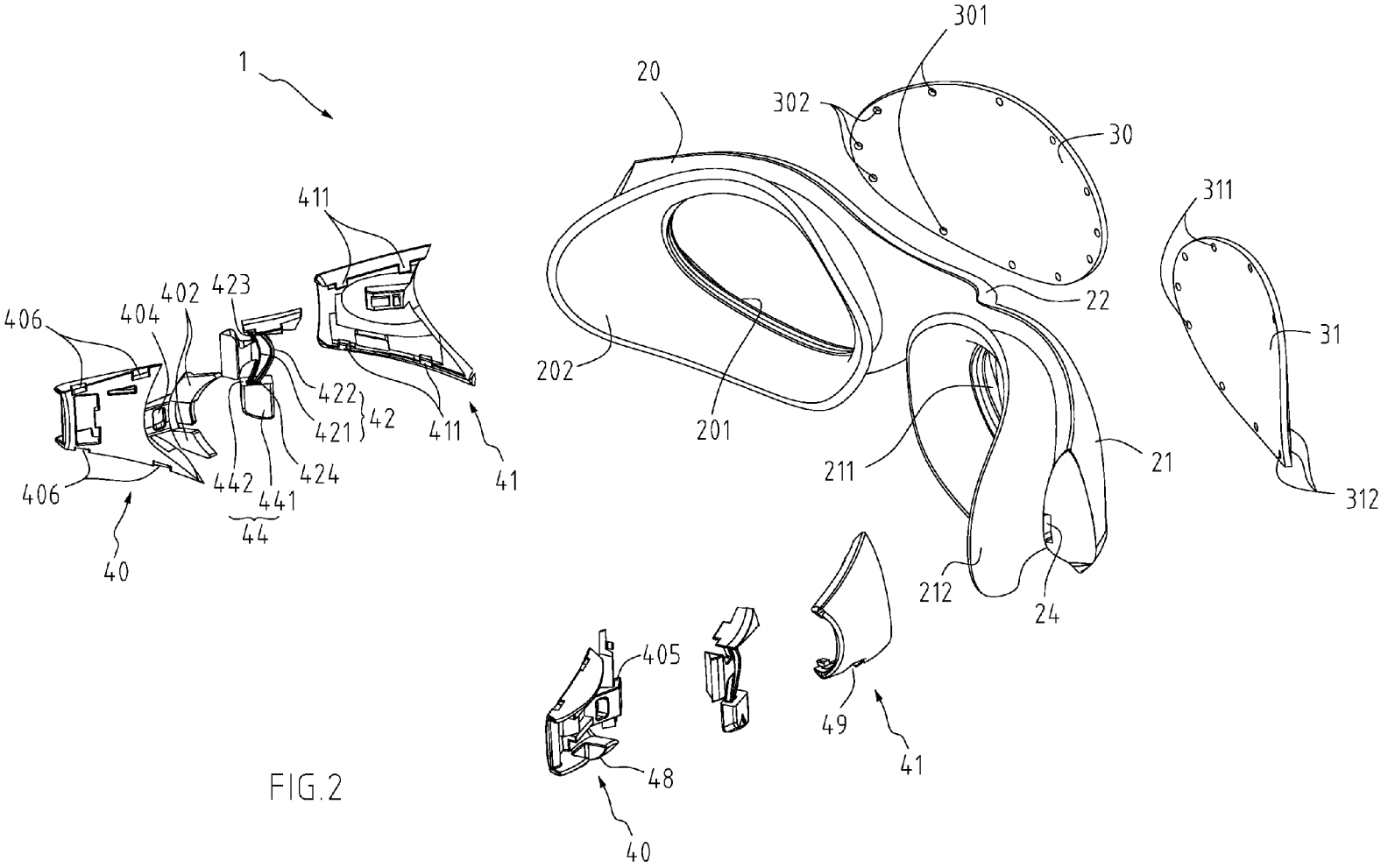
Figure 3A:
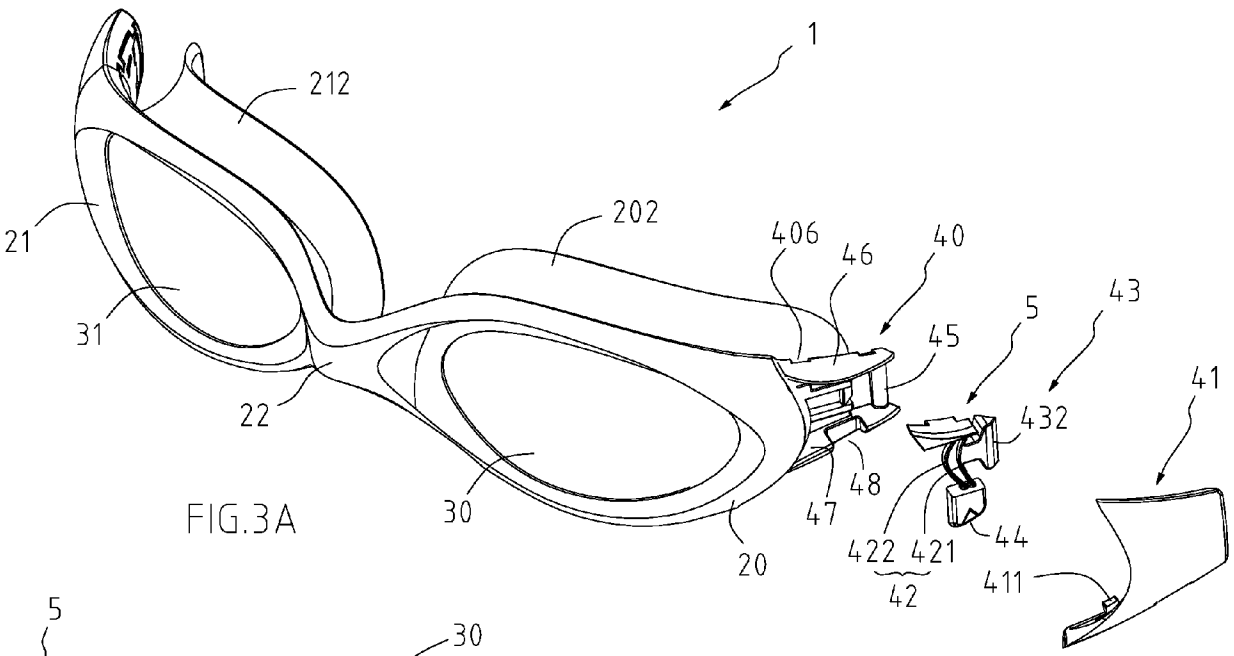
FIG. 3A is a partially perspective assembly view of FIG. 1.
Figure 3B:
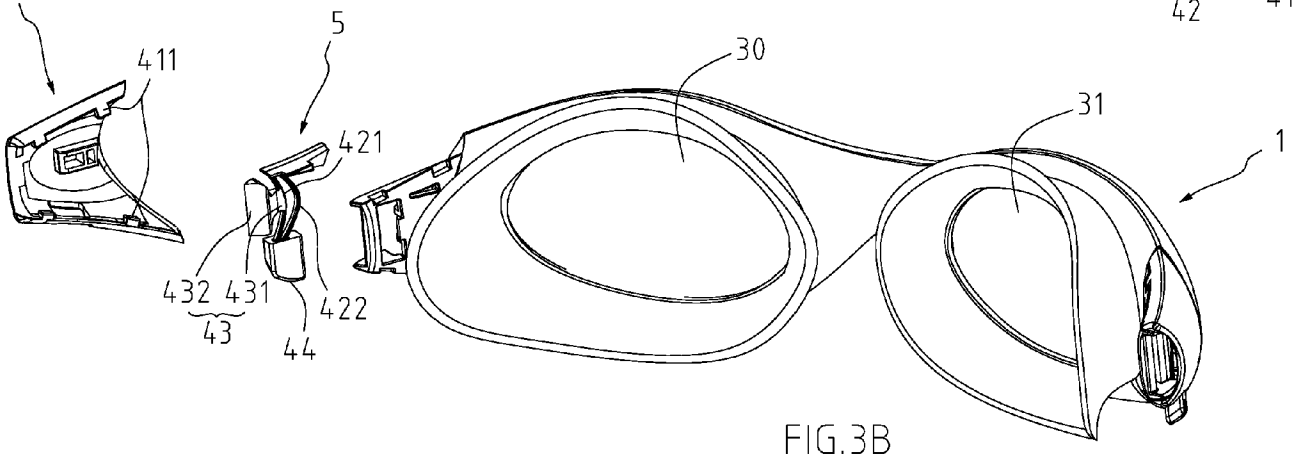
FIG. 3B is FIG. 3A viewed at a different angle.
Figure 4:
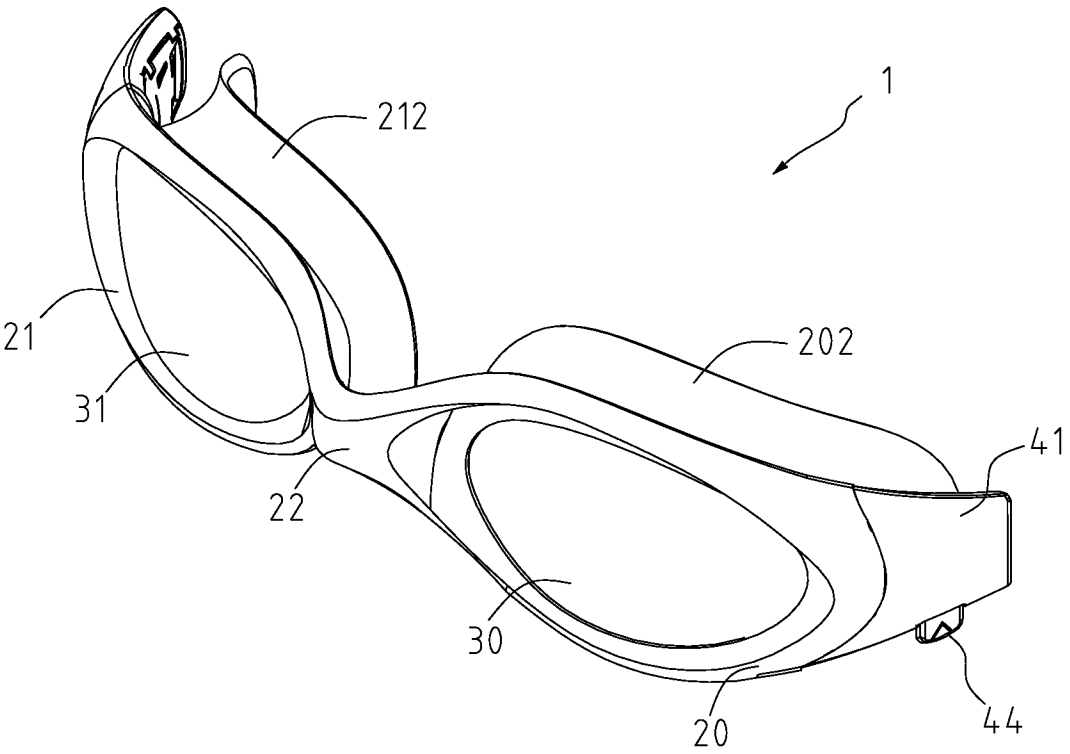
FIG. 4 is a perspective assembly view of FIG. 1.

Referring to FIGS. 1 and 2, a pair of swim goggles of the present invention include a lens frame body 2, a lens unit including left and right lenses 30, 31, and buckle devices 4, wherein the lens frame body 2 is made of Therma Plastic Rubber (TPR) and integrally formed with left and right frames 20, 21 and a nose frame 22. The left and right frames 20, 21 are formed with receiving grooves 201, 202 for receiving the left and right lenses 30, 31, respectively. Furthermore, contact portions 202, 212 are integrally from on the left and right frames 20, 21, respectively. The contact portions 202, 212 are made of Therma Plastic Rubber (TPR) and are served to contact a wearer's face by giving a comfortable feeling. Moreover, slits 24 are formed on outer sides of the left and right frames 20, 21, respectively.

The left and right lenses 30, 31 are provided with a plurality of injection holes 301, 311 formed on peripheral sides thereof. The injection holes 301, 311 are used for facilitating the integral formation of the lens frame body 2 and the lenses 30, 31. Besides, the left and right lenses 30, 31 are formed with three position holes 302, 312 on outer sides thereof, respectively, for being mounted to position sticks 403 as described below. In assembly, the left and right lenses 30, 31 are received in the receiving slots 201, 211 and integrally formed with the left and right frames 20, 21 by injection molding.

Figure 6:
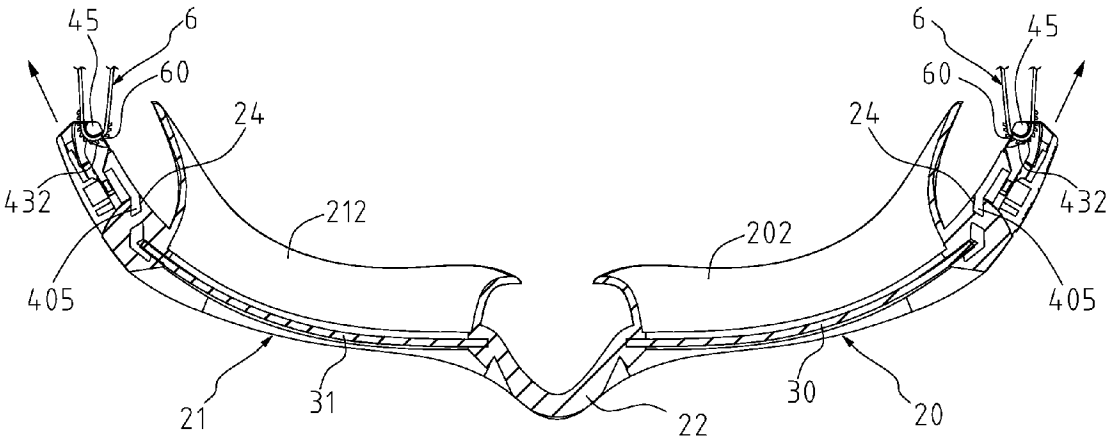
FIGS. 6 to 8 are cross-sectional views taken along lines 6-6, 7-7, and 8-8 in sequence in FIG. 5.
Figure 5:
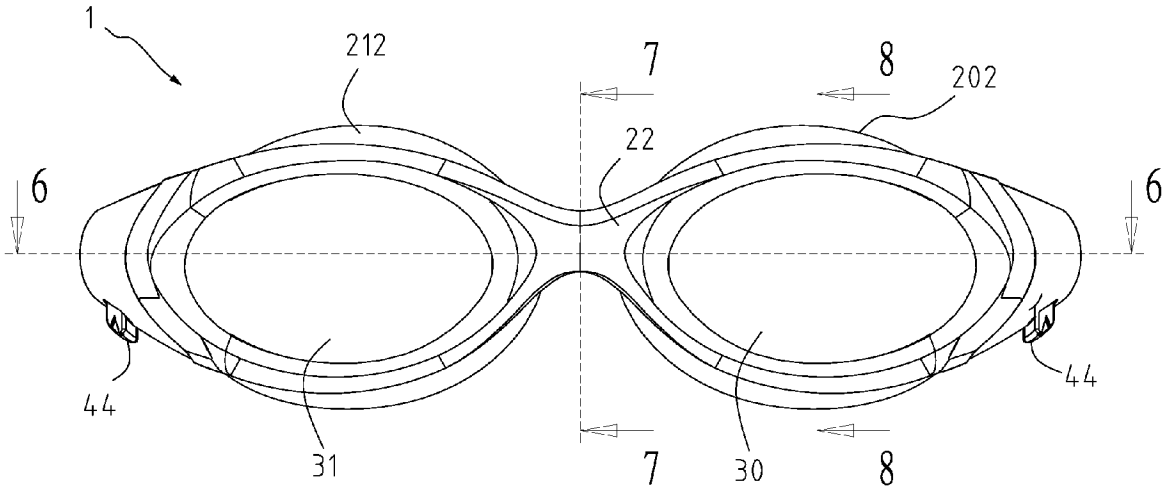
FIG. 5 is a front elevation view of FIG. 4.
Figure 8:
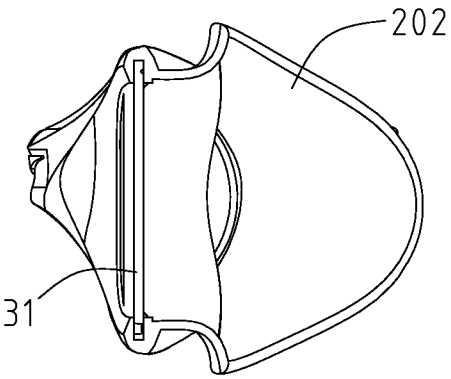
Figure 7:
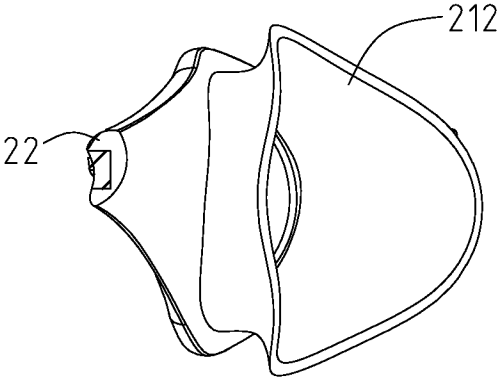
Figure 9:
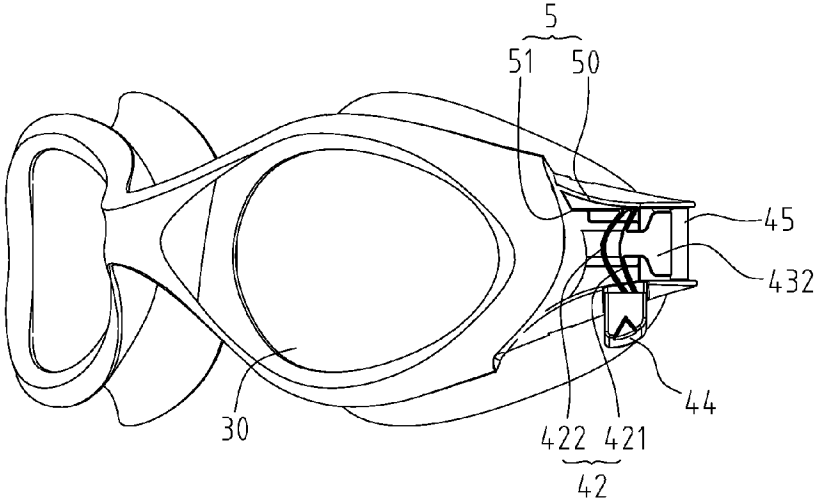
FIG. 9 is a schematic perspective view of FIG. 4 in which a second casing is off.

Each of the buckle devices 4 includes a first casing 40 and a second casing 41 assembled with the first casing 40 for allowing a head strap 6 to move therebetween, and a resilient element 42, an engaging arm 43 and a button 44 all disposed between the first and second casings 40, 41. The number of the button 44 in this embodiment is one, but it can be two in alternative, and the alternative two buttons are disposed opposite to each other. The first casing 40 includes a base, upper and lower walls 46, 47 extending laterally from the base, and a position arm 401 extending obliquely from a side of the base. The position arm 401 includes a curved portion 402 having a plurality of position sticks 403 for being mounted to respective position holes 302, 312 of the left and right lenses 30, 31. The position arm 401 further has an injection hole 404 thereon, which functions as the other injection holes 301, 311 as to facilitate the integral formation of the lens frame body 2. Moreover, the position arm 401 has a mounting plate 405 extending and bending from a front end thereof. The mounting plate 405 is spaced away from the curved portion 402 and mounted in the slit 24 (as shown in FIGS. 2 and 6) and further cooperate with the curved portion 402 in order to clip the left and right lenses 30, 31, whereby securing the first casing 40. Accordingly, the position arm 401, the curved portion 402 and peripheral sides of the left and right lenses 30, 31 are integrally formed with the lens frame body 2 by the injection molding technique. The first casing 40 has a shaft 45 disposed between the upper and lower walls 46, 47 and spaced away from the base of the casing 40. The shaft 45 is served to support the head strap 6 when the head strap 6 is drawn between the base and the shaft 45.

The first casing 40 has notches 406, and the second casing 41 has fastening pegs 411 corresponding to the notches 406. When the first casing 40 is covered over by the second casing 41, the fastening pegs 411 are fastened with the notches 406. The first and second casings 40, 41 have cavities 48, 49 corresponding to the button 44, respectively, for allowing the button 44 to be exposed therefrom and to be operated.

The resilient element 42 includes a first base plate 421 and a second base plate 422 both bending in a same direction and spaced away from each other in a determined distance. The second base plate 422 bends at an angle larger than that of the first base plate 421. The first and second base plates 421, 422 are made of Nylon Resin of flexibility, and have end portions 423, 424 at opposite ends thereof, respectively. A fitting element 5 is disposed on the end portion 423 of the first and second base plates 421, 422. The fitting element 5 has a fitting face 50 and a connecting face 51, the connecting face 51 is integrally formed with the end portion 423 of the first and second base plates 421, 422, and the fitting face 50 is completely fitted to an inner side of the upper wall 46 of the first casing 40 after being assembled. In other words, the fitting element 5 is against the upper wall 46 when the button 44 is being pressed so that the first and second base plates 421, 422 are capable of twisting.

The engaging arm 43 has a connecting end 431 and an engaging end 432 opposite the connecting end 431, the connecting end 431 connected with the first base plate 421, the engaging end 432 engaged with one of retaining slots 60 of the head strap 6 (as shown in FIG. 6) after being assembled. The button 44 has a press portion 441 and a linking portion 442 opposite the press portion 441, the linking portion 44 integrally connects the end portion 424 of the first and second base plates 421, 422, and the press portion 441 is exposed to the first and second casings 40, 41 after being assembled. When the button 44 is being pressed, the first and second base plates 421, 422 twist simultaneously in a direction that the button 44 is being pressed.

Referring to FIG. 1 in combination with FIGS. 3A and 3B and FIGS. 4-5, the swim goggles 1 of the present invention in assembly is, firstly, to connect the position holes 302, 312 of the lenses 30, 31 to the position sticks 403 of the position arm 401, and then integrally form the lens frame body 2 with the position arm 401, the curved portion 402 and the peripheral sides of the left and right lenses 30, 31 by the injection molding technique, wherein the injection holes 301, 311 of the lenses 30, 31 and the injection hole 404 of the position arm 401 are served to facilitate the injection molding. Next, assemble the resilient element 42, the engaging arm 43, the button 44, and the fitting element 5 with the first casing 40; finally, assemble the second casing 41 with the first casing 40.

Figure 10:
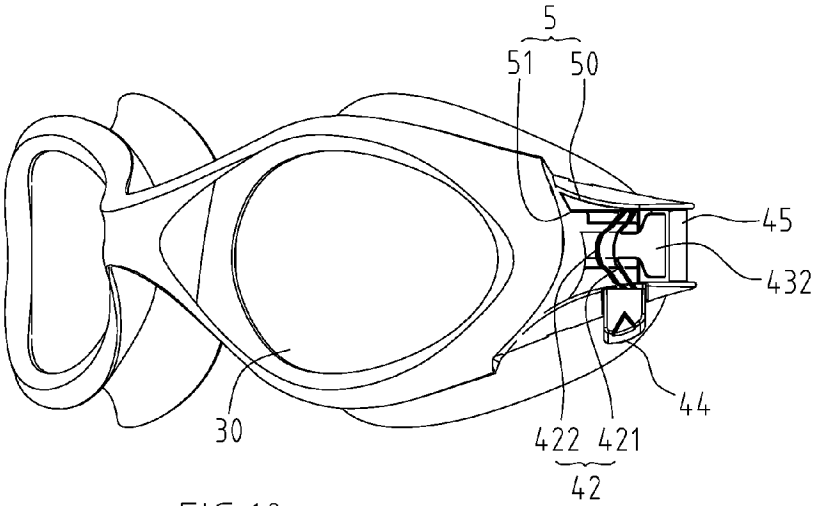
FIG. 10 is the same view as FIG. 9, but a button is being pressed.

Referring to FIGS. 6 to 10, after the swim goggles 1 of the present invention is being assembled, the head strap 6 is drawn through the first casing 40 between the shaft 45 and the base and around the shaft 45, wherein one of the retaining slots 60 is therefore engaged against the engaging end 432 of the engaging arm 43. As a result, the head strap 6 can only be drawn tightly in one direction (as shown in FIG. 6). For loosening the head strap 6, press the button 44 towards the upper wall 46 of the first casing 40 (as shown in FIG. 10), whereby the first and second base plates 421, 422 simultaneously twist and produce a stored energy, and the engaging arm 43 is drawn in a direction towards the position arm 401 and thus the engaging end 432 of the engaging arm 43 disengages from the one of the retaining slots 60. When stop pressing the button 44, the stored energy produced by the first and second base plates 421, 422 is released, and therefore the engaging arm 43 returns to its previous position.

It is understood that the invention may be embodied in other forms within the scope of the claims. Thus the present examples and embodiments are to be considered in all respects as illustrative, and not restrictive, of the invention defined by the claims.

What is claimed is:

1. A pair of swim goggles coupled with a head strap having retaining slots thereon, comprising:

a lens frame body;

a lens unit assembled with the lens frame body; and buckle devices disposed on left and right sides of the lens frame body, respectively, wherein each of the buckle devices comprises:

a first casing and a second casing assembled with the first casing for allowing the head strap to move therebetween; and a resilient element, an engaging arm and at least a button all disposed between the first and second casings, wherein the first casing includes an upper wall, a lower wall, and a position arm, and the resilient element includes a first base plate and a second base plate both bending in a same direction and spaced away from each other, each of the first and second base plates having an end portion at opposite ends thereof, the engaging arm having a connecting end and an engaging end opposite the connecting end, the connecting end directly connected with the first base plate, the engaging end being engageable with one of the retaining slots of the head strap after being assembled, the at least a button having a press portion and a linking portion opposite to the press portion, the linking portion connected to one of the end portions of each of the first and second base plates, and the press portion being exposed to the first and second casings after being assembled, and wherein the at least a button is disposed at lower sides of the first and second casings, and the first and second casings are formed with cavities corresponding to the button, respectively, for allowing the button to be exposed therefrom and to be operated;

wherein the first and second base plates are bent and twisted simultaneously in a same way with the second base plate bent at an angle larger than that of the first base plate when a force is applied by pressing the button towards the upper wall of the first casing so that the engaging arm is drawn in a direction towards the position arm to disengage from the one of the retaining slots.

2. The swim goggles of claim 1, wherein the first and second base plates are made of nylon resin.

3. The swim goggles of claim 2, wherein the first casing has a shaft for supporting the head strap.

4. The swim goggles of claim 1, wherein the first casing has notches, and the second casing has fastening pegs corresponding to the notches and being fastened with the notches.

5. The swim goggles of claim 1, wherein a fitting element is disposed between the first casing and the second casing, the fitting element has a fitting face and a connecting face, the connecting face connects the other one of the end portions of each of the first and second base plates, and the fitting face is attached to an inner side of the first casing.

6. The swim goggles of claim 1, wherein the lens frame body includes left and right frames, and a nose frame formed integrally with the left and right frames, the lens unit includes a left lens and a right lens, and the left and right frames have receiving grooves for receiving the left and right lenses, respectively.

7. The swim goggles of claim 6, wherein the lens frame body is made of Therma Plastic Rubber (TPR).

8. The swim goggles of claim 7, wherein a plurality of position holes are formed in a peripheral region of the left and right lenses, the position arm includes a curved portion having a plurality of position sticks for being mounted to respective position holes of the left and right lenses.

9. The swim goggles of claim 1, wherein each of the position arms has a mounting plate at a front end thereof, a slit is formed on outer sides of the left and right frames, respectively, and the mounting plate is mounted in the slit to further secure the first casing to the lens frame body.

10. The swim goggles of claim 1, wherein the left and right frames each has a plurality of injection holes formed in a peripheral region thereof.

11. The swim goggles of claim 9, wherein the position arm has at least an injection hole thereon.

12. The swim goggles of claim 10, wherein each of the left and right frames is further integrally formed with a contact portion made of Therma Plastic Rubber (TPR).

* * * * *